US008857414B2

(12) United States Patent
Takata

(10) Patent No.: US 8,857,414 B2
(45) Date of Patent: Oct. 14, 2014

(54) VEHICLE FUEL SUPPLY SYSTEM

(75) Inventor: Minoru Takata, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 272 days.

(21) Appl. No.: 13/327,205

(22) Filed: Dec. 15, 2011

(65) Prior Publication Data

US 2013/0025572 A1 Jan. 31, 2013

(30) Foreign Application Priority Data

Jul. 27, 2011 (JP) ..... 2011-164485

(51) Int. Cl.
*F02M 37/20* (2006.01)
*F02M 37/10* (2006.01)
*F02M 37/22* (2006.01)

(52) U.S. Cl.
CPC ..... *F02M 37/106* (2013.01); *F02M 37/20* (2013.01); *F02M 37/103* (2013.01); *F02M 2037/228* (2013.01)
USPC ..... 123/509

(58) Field of Classification Search
CPC ... F02M 37/10; F02M 37/103; F02M 37/106; F02M 37/20; F02D 9/006
USPC ..... 123/509, 506, 495, 497, 516; 417/283, 417/199.2, 423.3
See application file for complete search history.

(56) References Cited

U.S. PATENT DOCUMENTS

| | | | | |
|---|---|---|---|---|
| 6,981,490 | B2 * | 1/2006 | Nagata et al. | 123/514 |
| 2002/0085930 | A1 * | 7/2002 | Hiraiwa et al. | 417/307 |
| 2004/0258545 | A1 * | 12/2004 | Yu | 417/423.14 |
| 2007/0269320 | A1 * | 11/2007 | Yoshioka | 417/283 |

FOREIGN PATENT DOCUMENTS

| | | | | |
|---|---|---|---|---|
| JP | 6334388 A | * | 3/1988 | F02M 37/20 |
| JP | 63173841 A | * | 7/1988 | F02M 37/20 |
| JP | 2007-46562 A | | 2/2007 | |
| JP | 2010-144594 A | | 7/2010 | |

* cited by examiner

*Primary Examiner* — Mahmoud Gimie
(74) *Attorney, Agent, or Firm* — Sughrue Mion, PLLC

(57) ABSTRACT

There are provided a flange mounted in the upper opening of a fuel tank; a fuel pump that takes in a fuel in the fuel tank through a strainer, boosts the pressure of the fuel, and discharges the fuel; a high-pressure filter that filters a fuel that has been discharged from the fuel pump; and a pressure regulator that maintains within a predetermined range the pressure of a fuel that has been filtered by the high-pressure filter. At the bottom portion of the fuel pump including the vapor discharge outlet, there is provided a member that prevents a fuel in the fuel tank from flowing into the pump flow path where the pressure of the fuel is boosted, when pressure loss of the strainer increases.

3 Claims, 6 Drawing Sheets

VEHICLE FUEL SUPPLY SYSTEM

BACKGROUND OF THE INVENTION

1. Field of the Invention

The present invention relates to a vehicle fuel supply system that pressure-transmits a fuel in a fuel tank to an injector and the like of a vehicle internal combustion engine and particularly to discharge of gas such as vapor from a pump flow path.

2. Description of the Related Art

In order to trap foreign substances such as grit and dust included in a fuel and to stably supply the fuel, for example, to the injector of a fuel injection device mounted in an engine, foreign substances in a fuel tank are removed, at first, by a relatively coarse strainer, such as a mesh formed of nylon or the like, that is provided at the inlet of a fuel pump. It is widely known that foreign substances that pass through the strainer or foreign substances including abrasion powder, of a brush or a commutator, that is produced in a motor unit incorporated in the fuel pump, are trapped by a high-pressure filter, such as a paper-made filtration element, disposed at a downstream side of the fuel pump (at the next stage of the fuel pump in terms of the fuel flow path).

For the purpose of performing the foregoing stable supply of a fuel to an injector, it is indispensable to boost the pressure of the fuel in the pump flow path; however, when at this time, vapor-including air bubbles (referred to as vapors, hereinafter), as fuel vapors, that are produced because the fuel pressure is high are discharged toward the injector along with the fuel, an error in the amount of fuel injection by the injector may be caused. Accordingly, it is widely known that a vapor discharge outlet is provided in a pump flow path (for example, refer to Patent Document 1).

Meanwhile, in the case where due to a change with time, the intake pressure loss of a strainer increases, the pressure in the vicinity of the vapor discharge outlet becomes negative and hence the fuel is taken in through the vapor discharge outlet. It goes without saying that the fuel to be taken in has not passed through the strainer, which is in the original flow path; therefore, grit and dust also intrude along with the fuel, thereby causing abrasion of the pump chamber or clogging in the high-pressure filter. Accordingly, it is known that in a vapor discharge outlet, there is provided a check valve that allows discharge of vapors and prevents the fuel from flowing reversely (for example, refer to Patent Document 2).

PRIOR ART REFERENCE

Patent Document

[Patent Document 1] Japanese Patent Application Laid-Open No. 2007-46562 (page 4, lines 22 through 29)

[Patent Document 2] Japanese Patent Application Laid-Open No. 2010-144594 (page 7, lines 34 through 36)

Although being downsized by omitting the valve opening spring and improved in the activity of the ball valve at a time of reverse flow, the check valve disclosed in Patent Document 2 needs a considerable space, between the check valve itself and a flange or eventually the fuel tank, that is originally required for disposing a "valve"; therefore, in terms of downsizing of the whole fuel supply system and the flexibility in providing the check valve in the fuel tank, there is still room for improvement.

BRIEF DESCRIPTION OF THE DRAWINGS

The present invention has been implemented in order to solve the foregoing problems; the objective thereof is to obtain a vehicle fuel supply system that can prevent with a simple configuration the reverse flow from a vapor discharge outlet.

A vehicle fuel supply system according to the present invention is provided with a flange mounted in the upper opening of a fuel tank; a fuel pump that takes in a fuel in the fuel tank through a strainer, boosts the pressure of the fuel, and discharges the fuel; a high-pressure filter that filters the fuel that has been discharged from the fuel pump; and a pressure regulator that maintains within a predetermined range the pressure of the fuel that has been filtered by the high-pressure filter. In the vehicle fuel supply system, there is provided a vapor discharge outlet in the pump flow path where the pressure of the fuel is boosted; and at the bottom portion of the fuel pump including the vapor discharge outlet, there is provided a member that prevents the fuel in the fuel tank from flowing into the pump flow path when the pressure loss of the strainer increases.

The present invention makes it possible to provide a vehicle fuel supply system that is configured in a compact and inexpensive manner and is superior in maintaining its performance and in the maintainability.

The foregoing and other object, features, aspects, and advantages of the present invention will become more apparent from the following detailed description of the present invention when taken in conjunction with the accompanying drawings.

BRIEF DESCRIPTION OF THE DRAWINGS

Figure 1:
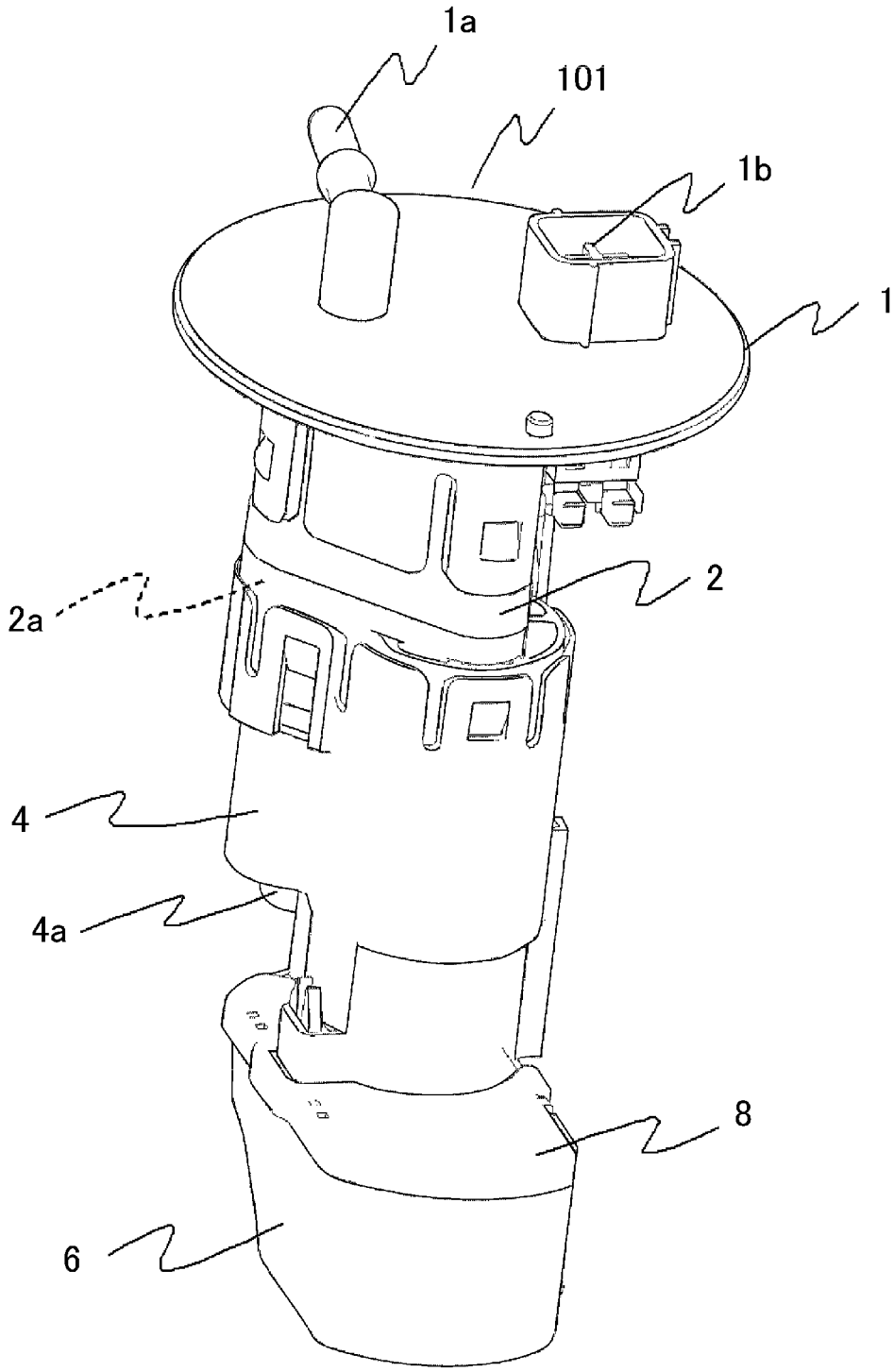
Figure 2:
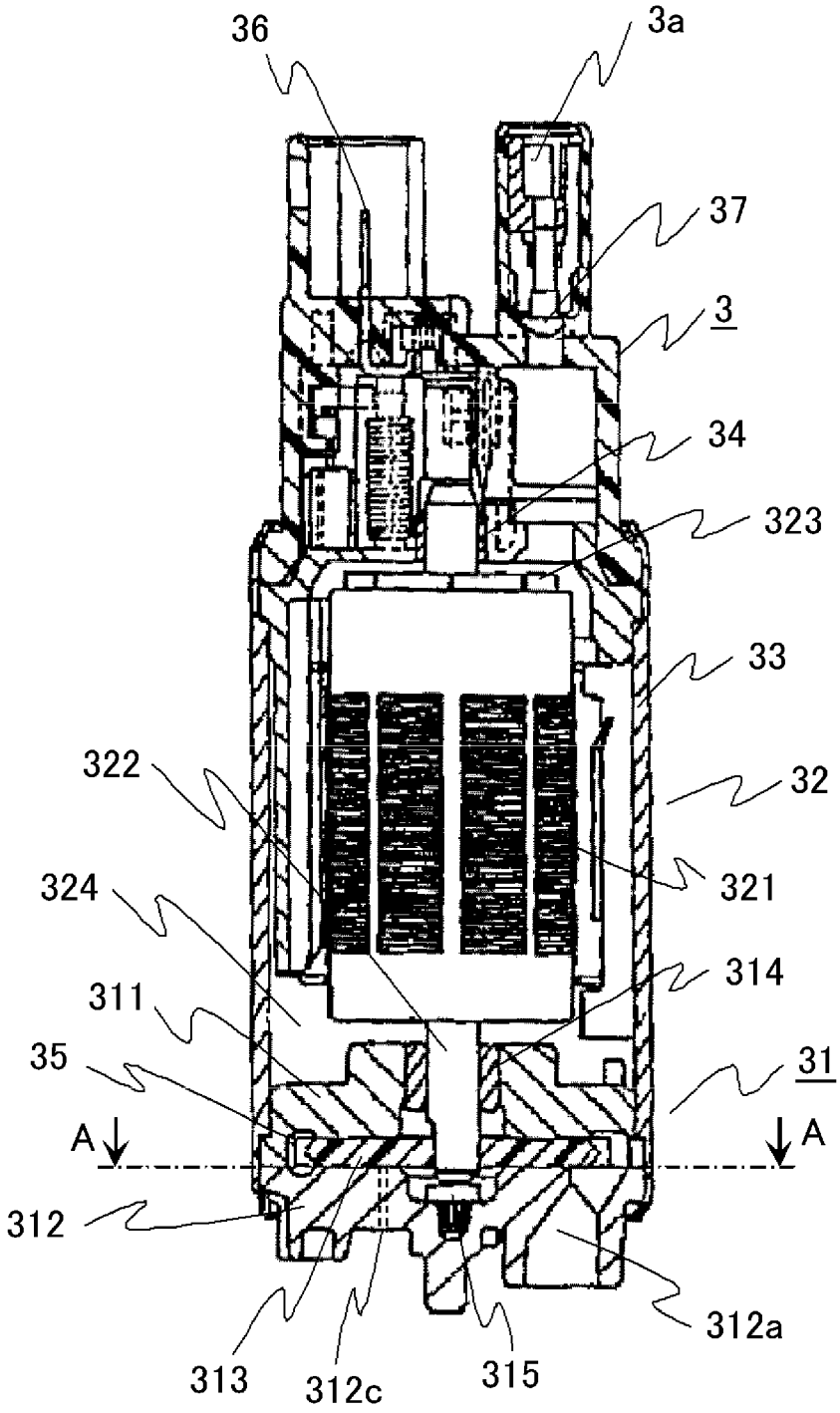
Figure 3:
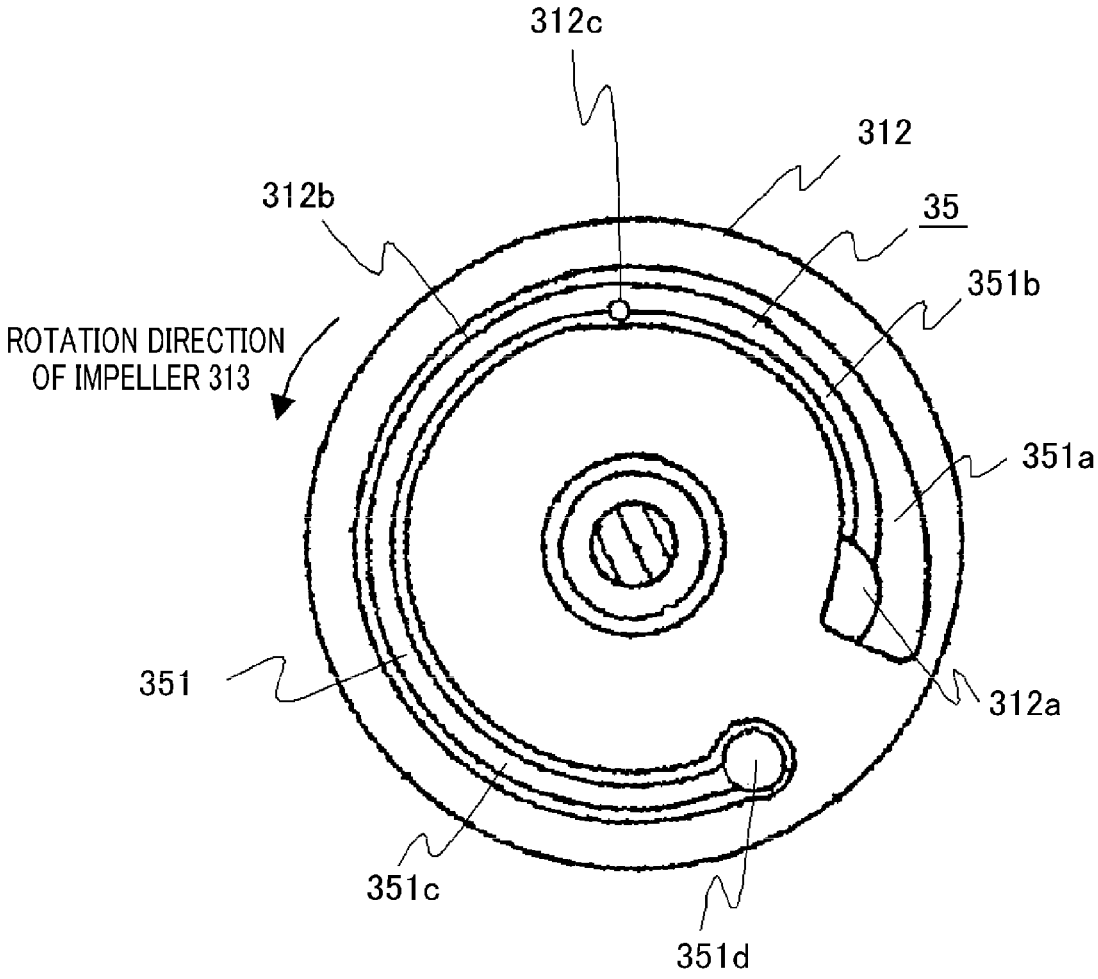
Figure 4:
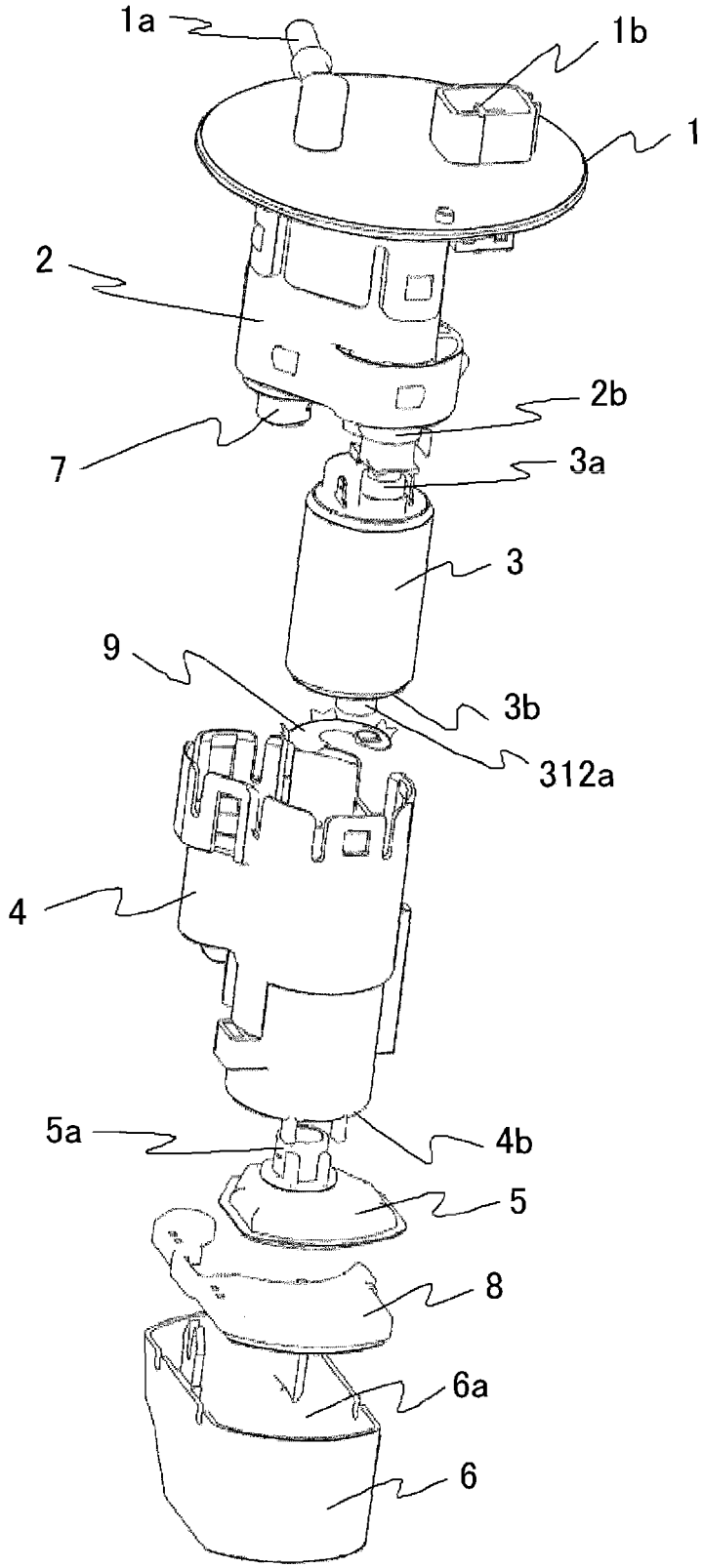
Figure 5:
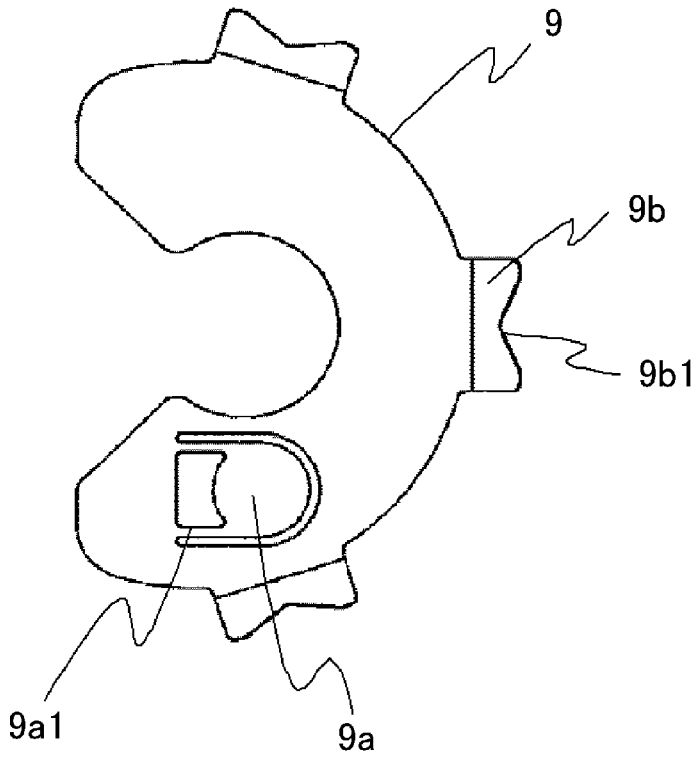
Figure 6:
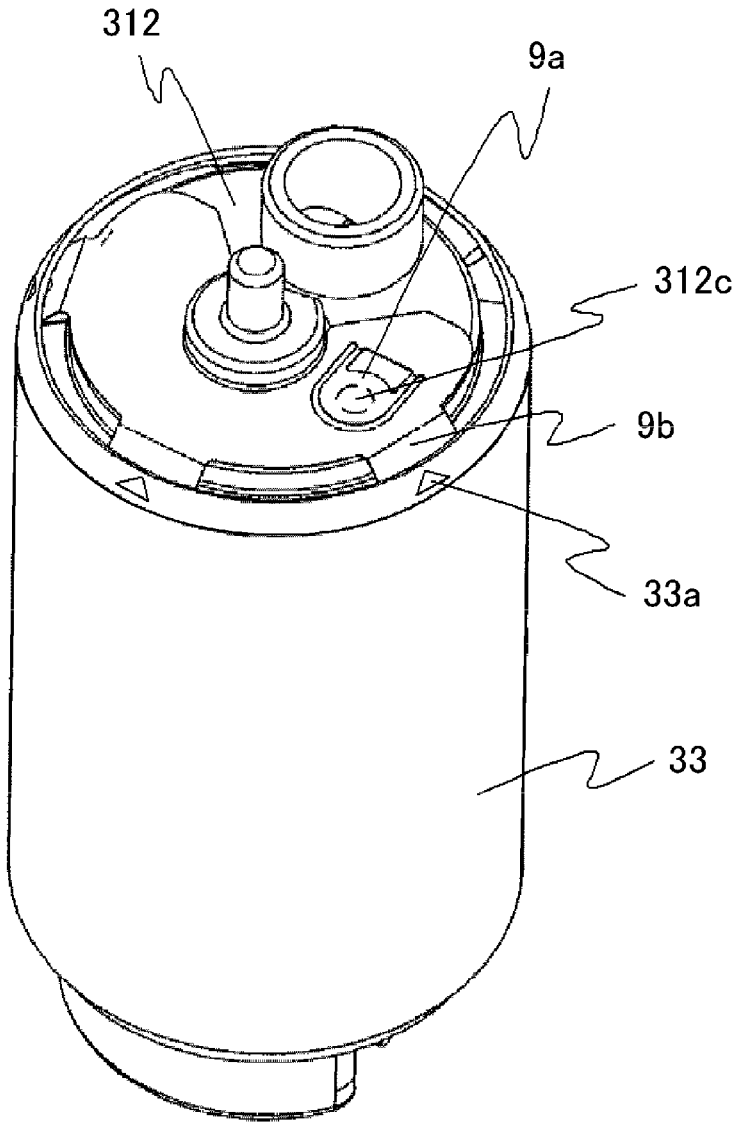

FIG. 1 is an external perspective view of a vehicle fuel supply system according to Embodiment 1 of the present invention;

FIG. 2 is a cross-sectional view illustrating a fuel pump according to Embodiment 1 of the present invention;

FIG. 3 is a cross-sectional view of the fuel pump in FIG. 2 as viewed along the line A-A;

FIG. 4 is an exploded perspective view of the vehicle fuel supply system in FIG. 1;

FIG. 5 is a plan view illustrating a reed valve according to Embodiment 1 of the present invention; and FIG. 6 is a perspective view illustrating a fuel pump on which there is mounted a reed valve according to Embodiment 1 of the present invention.

DETAILED DESCRIPTION OF THE PREFERRED EMBODIMENTS

Embodiment 1

FIG. 1 is an external perspective view of a vehicle fuel supply system (referred to as a fuel supply system, hereinafter) according to Embodiment 1 of the present invention; FIG. 2 is a cross-sectional view illustrating a fuel pump; FIG. 3 is a plan view illustrating a casing cover and corresponds to a cross-sectional view of the fuel pump in FIG. 2 as viewed along the line A-A; FIG. 4 is an exploded perspective view of the vehicle fuel supply system illustrated in FIG. 1; FIG. 5 is a plan view illustrating a reed valve; FIG. 6 is an external perspective view illustrating a fuel pump on which the foregoing reed valve is mounted.

In FIG. 1, a fuel supply system 101 is configured roughly with a flange 1 that is formed of an insulating resin and is provided, through integral molding, with a connector 1*b* and a discharging pipe 1*a* with which, for example, a fuel hose lead to an unillustrated injector is connected; a filter unit 2 engaged with the flange 1, for example, through snap fitting;

a pump holder 4 that holds a fuel pump 3 (refer to FIG. 4) and is engaged with the filter unit 2, for example, through snap fitting; and a chamber 6 that incorporates a strainer 5 (refer to FIG. 4) fit to the fuel pump 3 and is engaged with the pump holder 4, for example, through snap fitting.

The fuel supply system 101 is incorporated in an unillustrated vehicle fuel tank in such a way that the flange 1 covers the opening hole of the fuel tank, and supplies a fuel taken in from the fuel tank by use of the fuel pump 3 to an injector, through a high-pressure filter 2*a* provided inside the filter unit 2. It is well known that the strainer 5 removes foreign substances in the fuel tank and the high-pressure filter 2*a* traps foreign substances that cannot be removed by the strainer 5 or foreign substances including abrasion powder, for example, of a commutator 323 (refer to FIG. 2) incorporated in the fuel pump 3. It is also well known that a pressure regulator 7 (refer to FIG. 4) is fit to the filter unit 2 in a liquid-tight manner, for example, by use of an unillustrated O-ring and the pressure regulator 7 maintains at a predetermined value the pressure of the fuel to be supplied to the injector.

In the present invention, when the fuel pressure is maintained at a predetermined value, the surplus fuel is temporarily collected in the pump holder 4 and then is made to flow into the chamber 6 through an unillustrated discharging hole provided in the pump holder 4; furthermore, the fuel, to be in the fuel tank, that is temporarily reserved in a fuel reservoir 4*a* provided integrally in the pump holder 4 is made to flow into the chamber 6 through an unillustrated discharging hole provided in the fuel reservoir 4*a*. As a result, there is maintained the condition that the fuel is always contained in the chamber 6, i.e., the strainer 5 is soaked in the fuel. This is just because the fuel supply system is configured in such a way that even when the fuel in the fuel tank is insufficient in quantity and the oil level changes due to acceleration/deceleration or a change in the posture, the fuel pump 3 can securely take in the fuel without undergoing any effect of the change in the oil level. In addition, an opening portion 6*a* (refer to FIG. 4) of the chamber 6 is closed by a chamber cover 8 so that even when acceleration/deceleration or a change in the posture occurs, the fuel reserved in the chamber 6 does not jump out of the chamber 6.

Next, the configuration of the fuel pump 3 will be explained with reference to FIG. 2. The fuel pump 3 is configured with a pump unit 31 and a motor unit 32 as an electromagnetic drive unit that drives the pump unit 31. The motor unit 32 is a DC motor with a brush and is configured in such a way that an unillustrated permanent magnet is circularly disposed inside a cylindrical housing 33 and an armature 321 is disposed, concentrically with the permanent magnet, on the inner circumferential side of the permanent magnet; in contrast, the pump unit 31 is configured with a casing main body 311, a casing cover 312, an impeller 313, which is a rotating body, and the like.

The casing main body 311 and the casing cover 312 are formed, for example, through aluminum die-cast molding; the casing main body 311 and the casing cover 312 configure a single casing member (undesignated); the impeller 313 is pivotably incorporated in the casing member. The casing main body 311 is fixed in such a way as to be pressed into the one end portion of the housing 33; the casing cover 312 is fixed to one end of the housing 33 through swaging or the like, while being covered by the casing main body 311. A bearing 314 is fit to the center of the casing main body 311 and a thrust bearing 315 is fixed in such a way as to pressed into the center of the casing cover 312, so that one end portion of a rotating shaft 322 of the armature 321 is radially and pivotably supported by the bearing 314 and the thrust-direction load is supported by the thrust bearing 315. The other end portion of the rotating shaft 322 is radially and pivotably supported by a bearing 34.

A fuel-intake inlet 312*a* is formed in the casing cover 312; it is well known that due to the rotation of the impeller 313 having blade pieces on the periphery thereof, the fuel in the fuel tank passes through the strainer 5 and is taken in into the pump flow path 35 through the fuel-intake inlet 312*a*. The pump flow path 35 is situated along the outer circumference of the impeller 313 and is formed, approximately in a C shape, between the casing main body 311 and the casing cover 312. In addition, it is also well known that the fuel that has been taken in into the pump flow path 35 is pressure-boosted due to the rotation of the impeller 313 and then is pressure-transmitted to a fuel chamber 324 of the motor unit 32.

Here, the details of the casing cover 312 will be explained. In FIG. 3, a C-shaped fuel groove 312*b* is formed in the surface, of the casing cover 312, that faces the casing main body 311 (refer to FIG. 2). A groove path 351 that is formed of the fuel groove 312*b* and is included in the pump flow path 35 (as described above, the pump flow path 35 is configured with the groove path 351 and an unillustrated portion that is provided in the casing main body 311 and corresponds to the groove path 351) is configured with an inlet portion 351*a* that communicates with the fuel-intake inlet 312*a*; an introduction path portion 351*b* whose path width and path depth gradually decrease after leaving the inlet portion 351*a*; and a pressure-boosting path portion 351*c* formed from the introduction path portion 351*b* to a terminal end 351*d* of the groove path 351. In the groove path 351, there is formed a vapor discharge outlet 312*c* (refer also to FIG. 2) that penetrates the casing cover 312 and connects the pump flow path 35 with the inside of the fuel tank outside the fuel pump 3. The vapor discharge outlet 312*c* is provided at a position that is more advanced in the direction opposed to the rotation direction of the impeller 313 than the terminal end 351*d*; the function thereof is to discharge vapor—fuel vapor produced in the pump flow path 35—to the fuel tank.

Next, the assembly procedure for the fuel supply system 101 will be explained with reference to FIG. 4. After the flange 1 and the filter unit 2 are engaged with each other, a fuel discharging outlet 3*a* is fit in a liquid-tight manner to a fuel introduction inlet 2*b* of the filter unit 2. At this time, a reed valve 9 is preliminarily mounted on a bottom portion 3*b*, which is at the lower side of the fuel pump 3 on the plane of the paper. In the case where in this situation, the pump holder 4 is engaged with the filter unit 2 in such a way that the fuel-intake inlet 312*a* is looked through from a bottom surface 4*b* of the pump holder 4, the fuel pump 3 is supported, and the pressure regulator 7 is also supported at a position with which surplus fuel from the pressure regulator 7 can appropriately be discharged through the foregoing discharge outlet. After that, a connection tube 5*a* of the strainer 5 is fit to the fuel-intake inlet 312*a*; then, at last, the pump holder 4 is engaged with the chamber 6 that has been covered with the chamber cover 8.

The operation of the fuel supply system 101, especially the operation regarding fuel supply is well known. That is to say, after an unillustrated lead wire connects the connector 1*b* with a connector 36 (refer to FIG. 2) of the fuel pump 3, the fuel pump 3 is driven through the lead wire; then, due to the rotation of the impeller 313, the fuel in the fuel tank is taken in into the fuel-intake inlet 312*a* by way of the strainer 5, pressure-boosted, and discharged through the fuel discharging outlet 3*a*. Then, the discharged fuel is supplied to the injector and the like, by way of the high-pressure filter 2*a*, the discharging pipe 1*a*, and an unillustrated fuel hose. In contrast, in the case where the pressure of the fuel in the filter unit 2 is higher than a predetermined value, this fuel, as a surplus fuel, is discharged from the pressure regulator 7 so that the pressure of the fuel in the filter unit 2 is maintained at a predetermined value. The discharged surplus fuel is, as described above, reserved in the chamber 6 and then is efficiently taken in into the fuel-intake inlet 312*a* again, by way of the strainer 5. A check valve 37 (refer to FIG. 2) is contained in the fuel discharging outlet 3*a*; for example, when the engine is stopped, the check valve 37 holds the pressure inside the pipeline that is lead to the injector, so that the startability of the engine is kept excellent. Here, because a reed valve 9 that corresponds to the fuel-intake inlet 312*a* and is mounted on the bottom portion 3*b* of the fuel pump 3 is one of the principal parts of the present invention, it will be explained in detail below.

The reed valve 9 is a sheet-like member, i.e., a so-called tabular member that is machined to have a shape illustrated in FIG. 5; in the reed valve 9, there are provided a vapor discharge outlet occlusion unit 9*a* provided with a weakened part 9*a*1 and a plurality of (three, in this case) pump mounting units 9*b* that are folded frontward on the plane of the paper. At the front end of the pump mounting units 9*b*, there is formed a recess 9*b*1; as illustrated in FIG. 6, the recess 9*b*1 is inserted into a protrusion portion 33*a* that is produced when the casing cover 312 is swaged to one end of the foregoing housing 33, so that the pump mounting units 9*b* is mounted. Due to the mounting of the pump mounting units 9*b*, the vapor discharge outlet 312*c* is occluded by the vapor discharge outlet occlusion unit 9*a*.

This occlusion makes it possible to prevent the fuel in the fuel tank including a considerable amount of grit and dust from flowing into the pump flow path 35 when, for example, due to inferior fuel or oil supply in the open air, the intake ability of the strainer is deteriorated, i.e., the pressure loss increases. In contrast, in the case where the intake ability of the strainer 5 is normal, it is required to discharge vapor through the vapor discharge outlet 312*c*; however, because due to the provision of the weakened part 9*a*1, the fuel pressure in the vicinity of the vapor discharge outlet 312*c* is positive, the vapor discharge outlet occlusion unit 9*a* is "opened" and hence the produced vapor is discharged; thus, the fuel including vapor is not discharged to the injector. In addition, when the stability of the "opened" state and the gas-resistance are taken into consideration, it is desirable that for example, the reed valve 9 has a plate thickness of 0.05 mm and is made of a stainless steel member of spring characteristics. Because as described above, the fuel pump 3 is supported by the pump holder 4, i.e., the bottom portion 3*b* of the fuel pump 3 and the bottom surface 4*b* of the pump holder 4 are in contact with each other; therefore, In order not to disturb the "opened" operation of the reed valve 9 and taking the wall thickness of the bottom surface of the pump holder 4 into consideration, a relief, for example, of approximately 0.4 mm is applied to the bottom surface 4*b* of the pump holder 4 so that the vapor discharge outlet occlusion unit 9*a* can move.

As explained above, it is desirable that the vehicle to which the present invention is applied is, for example, a four-wheel buggy vehicle, for leisure or a race, with regard to which the inferior fuel or the oil supply in the open air are assumed. In other words, by occluding the vapor discharge outlet 312*c*, the user can learn that the reason why the fuel is not supplied to the injector lies in the replacement timing of the strainer 5. That is to say, there can be prevented "the circumstance in which because, although the replacement timing of the strainer 5 has come, the fuel including a considerable amount of grit and dust flows in through the vapor discharge outlet 312*c*, the fuel pump 3 or the high-pressure filter 2*a* undergoes damage and hence the fuel supply system 101 itself cannot help being replaced; therefore, the user of the foregoing four-wheel buggy vehicle can obtain a conspicuous effect that an economically superior fuel supply system is provided.

In this embodiment, there has been explained a fuel supply system provided with the high-pressure filter 2*a*; however, the present invention is not limited thereto. For example, by diminishing the so-called "aperture" of the strainer 5, the high-pressure filter can be omitted; thus, even a fuel supply system having no high-pressure filter does not depart from the scope of the present invention.

Various modifications and alterations of this invention will be apparent to those skilled in the art without departing from the scope and spirit of this invention, and it should be understood that this is not limited to the illustrative embodiments set forth herein.

What is claimed is:

1. A vehicle fuel supply system comprising:

a flange mounted in the upper opening of a fuel tank;

a fuel pump that takes in a fuel in the fuel tank through a strainer, boosts the pressure of the fuel in a pump flow path provided in the fuel pump, and discharges a pressurized fuel;

a high-pressure filter that filters the fuel that has been discharged from the fuel pump;

a pressure regulator that maintains within a predetermined range the pressure of the fuel that has been filtered by the high-pressure filter;

a vapor discharge outlet that is provided in the pump flow path, has an opening at an outer surface of the bottom portion of the fuel pump, and discharges a vapor in the pump flow path to the fuel in the fuel tank through the opening; and a member that prevents the fuel in the fuel tank from flowing into the pump flow path when pressure loss of a strainer increases, wherein the member is provided at the outer surface of the bottom portion of the fuel pump, and has a vapor discharge outlet occlusion unit, and the vapor discharge outlet occlusion unit occludes the opening of the vapor discharge outlet when pressure loss of the strainer increases.

2. The vehicle fuel supply system according to claim 1, wherein the member that prevents a fuel in the fuel tank from flowing into the pump flow path is a sheet-like reed valve.

3. The vehicle fuel supply system according to claim 2, wherein by being folded, the reed valve is engaged with the fuel pump.

* * * * *